United States Patent [19]

Stoffregen

[11] 4,079,852

[45] Mar. 21, 1978

[54] BLANK FOR A CONTAINER

[75] Inventor: Fritz Gunter Stoffregen, Moorabbin, Australia

[73] Assignee: Viscount Plastic Products Pty. Ltd., Braeside, Australia

[21] Appl. No.: 752,763

[22] Filed: Dec. 20, 1976

Related U.S. Application Data

[63] Continuation of Ser. No. 693,728, Jun. 7, 1976, abandoned, which is a continuation of Ser. No. 562,608, Mar. 27, 1975, abandoned.

[30] Foreign Application Priority Data

Apr. 4, 1974 Australia ..... 7152/74

[51] Int. Cl.[2] ..... B65D 25/00

[52] U.S. Cl. ..... 220/7; 220/62; 312/330 R; 220/416

[58] Field of Search ..... 220/6, 7, 9 R, 9 F, 220/62; 229/14 H, 30, 34 A, 34 HW; 312/330, 346, 347

[56] References Cited

U.S. PATENT DOCUMENTS

| | | | |
|---|---|---|---|
| 3,282,635 | 11/1968 | Himelreich | 220/9 R X |
| 3,349,289 | 10/1967 | Mueller | 220/62 X |
| 3,556,626 | 1/1971 | Shock | 312/330 |
| 3,639,027 | 1/1972 | Higdon, Jr. | 312/330 |
| 3,675,808 | 7/1972 | Brink | 220/7 |
| 3,759,600 | 9/1973 | MacDonald | 312/330 |
| 3,802,591 | 4/1974 | Mizushima et al. | 220/9 F |
| 3,826,554 | 7/1974 | Cornell | 312/330 |

*Primary Examiner*—Stephen Marcus

[57] ABSTRACT

A blank for forming an open topped container having at least one double wall. The blank comprises an open topped single walled container having a number of side walls. The single wall container has integrally formed therewith at least one panel which is foldable into a position where it overlies one of the side walls of the container.

20 Claims, 9 Drawing Figures

BLANK FOR A CONTAINER

This is a Continuation, of application Ser. No. 693,728, filed June 7, 1976, now abandoned which application is a continuation of application Ser. No. 562,608, filed Mar. 27, 1975, now abandoned.

This invention relates to plastic drawers.

There have been many attempts to produce plastic drawers but nobody has been able to produce a plastic drawer which is molded in one piece and has sufficient rigidity. For instance, in U.S. Pat. Nos. 3,556,626, 3,312,516, 3,282,635, and 3,726,579 there are disclosed techniques for forming drawers using a continuous extrusion which forms the side walls of the drawer. The extrusion is slotted to enable it to be folded about the corners of the base for the drawer. Even with the use of such extrusions the fabrication of drawers is time consuming.

Other known techniques involve molding components which can be used in a drawer construction. For instance U.S. Pat. Nos. 3,612,639, 3,639,027, and 3,650,592 disclose drawer constructions which involve the use of injection molded components which forms three of the side walls of a drawer. It is necessary, however, to assemble and affix the component with a base and front side wall for the drawer and these steps are time consuming. U.S. Pat. No. 3,462,208 discloses an integral molding of a base and three sides of a drawer. Even with this molding it is still necessary to assemble the drawer with a front side wall to the base.

It is the object of the invention to provide a drawer which is an integral one-piece molding.

According to the present invention there is provided a one-piece injection molded drawer comprising an open topped box-like structure having integral side walls and base, and hingedly connected to the structure, four outer side walls which overlie one of the integral side walls respectively of the box-like structure.

The drawer of the invention is molded in the form of a blank having an open topped box-like structure having integral side walls and base, and, hingedly connected to said structure, four panels which are foldable to positions where they overlie one of the integral side walls respectively of the box-like structure and serve as outer side walls for the drawer.

Erection of a drawer from the blank is simply accomplished by folding the panels about their hinges and retaining them in position perpendicular to the base of the structure. It will be apparent that in the drawer of the present invention, the external configuration of the erected drawer is solely dependent upon the initial configuration of the blank and is not subject to variation according to the skill of the person erecting it.

One example of the invention will now be described with reference to the accompanying drawings, in which.

Figure 1:
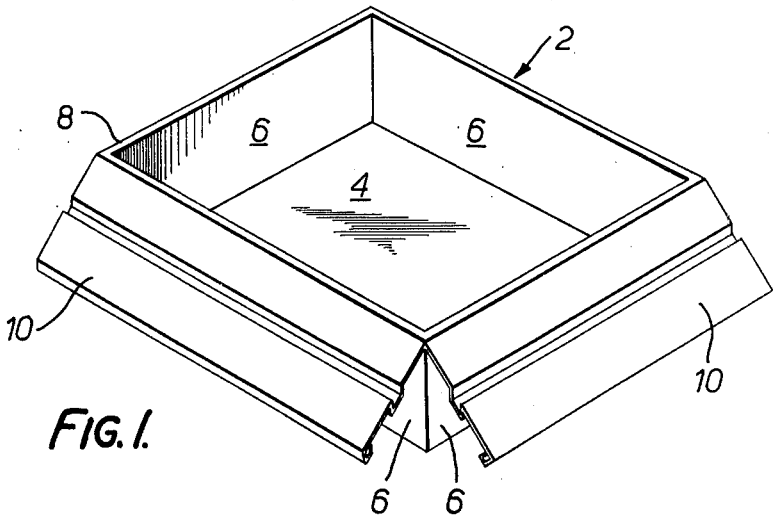
FIG. 1 is a perspective view of a blank for forming a drawer in accordance with the invention.

The blank 2 for erection into a drawer in accordance with the present invention comprises a base 4, four side walls 6 extending upwardly and splayed outwardly from the base, a flange 8 extending continuously about the upper edges of the side walls 6, and four panels 10 hingedly connected to the flange 8, the panels being of similar dimensions to adjacent side walls 6 so that, upon folding down of flanges about their hinge connection to the lip 8, they form outer side walls of drawer. The base 4, side walls 6, flange 8 and panels 10 are integrally molded from plastic material, such as polypropylene, with the panels 10 initially co-planar with the flange 8.

Figure 2:
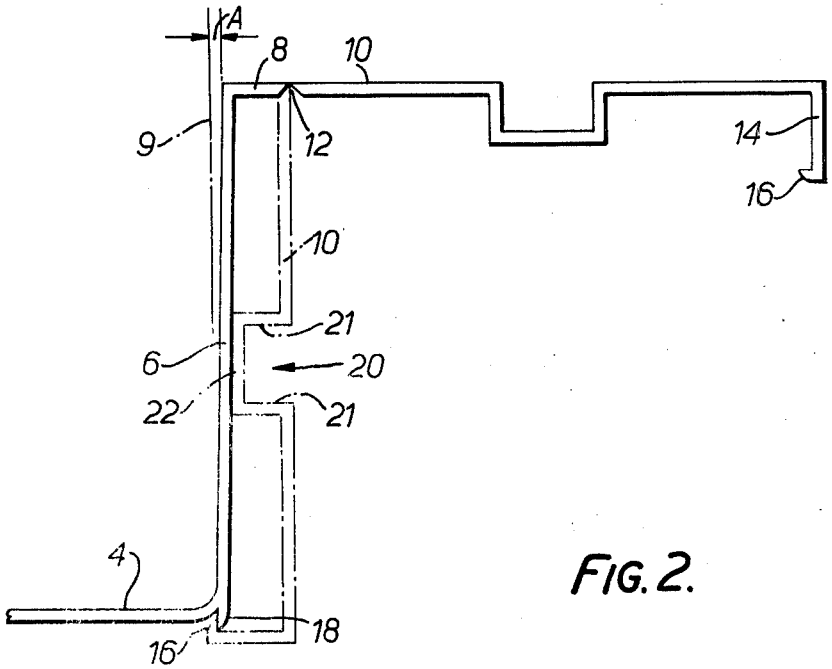
FIG. 2 is a cross-sectional view through the base and one of the sides of the drawer shown in FIG. 1.

Referring now to FIG. 2 there is shown part of the blank in the position in which it is molded. V-notches 12 are formed between the flange 8 and the panels 10 to serve as the hinge connection between them. The outer sides of the panels 10 have depending therefrom flanges 14 which, when the panels 10 are swung about their respective hinge connections to the flange 8 (as shown in broken lines), are parallel to the base 4 and form bottom running surfaces for the drawer 2. The lower sides of the flanges 14 are provided with longitudinally extending projections 16 which interlock with ribs 18 formed upon the underside of the base 4, the ribs forming extensions of the side walls to prevent the panels 10 from swinging outwards under their own resilience. The panels 10 may include a longitudinally extending channel 20 the side wall 21 of which may serve as side running surfaces for the drawer or to enable moldings (not shown) to be press fit between them to serve as projecting running surfaces for the drawer. The bottom wall 22 of the channel is shaped so as to bear against the side wall 6 when the blank is erected to impart additional rigidity to the drawer.

FIG. 2 also shows the angle A of outward splaying of the side walls 6 relative to a line 9 normal to the base 4. In the illustrated form the angle A is 3°.

Figures 3, 4, 5, 6, 7, 8, 9:
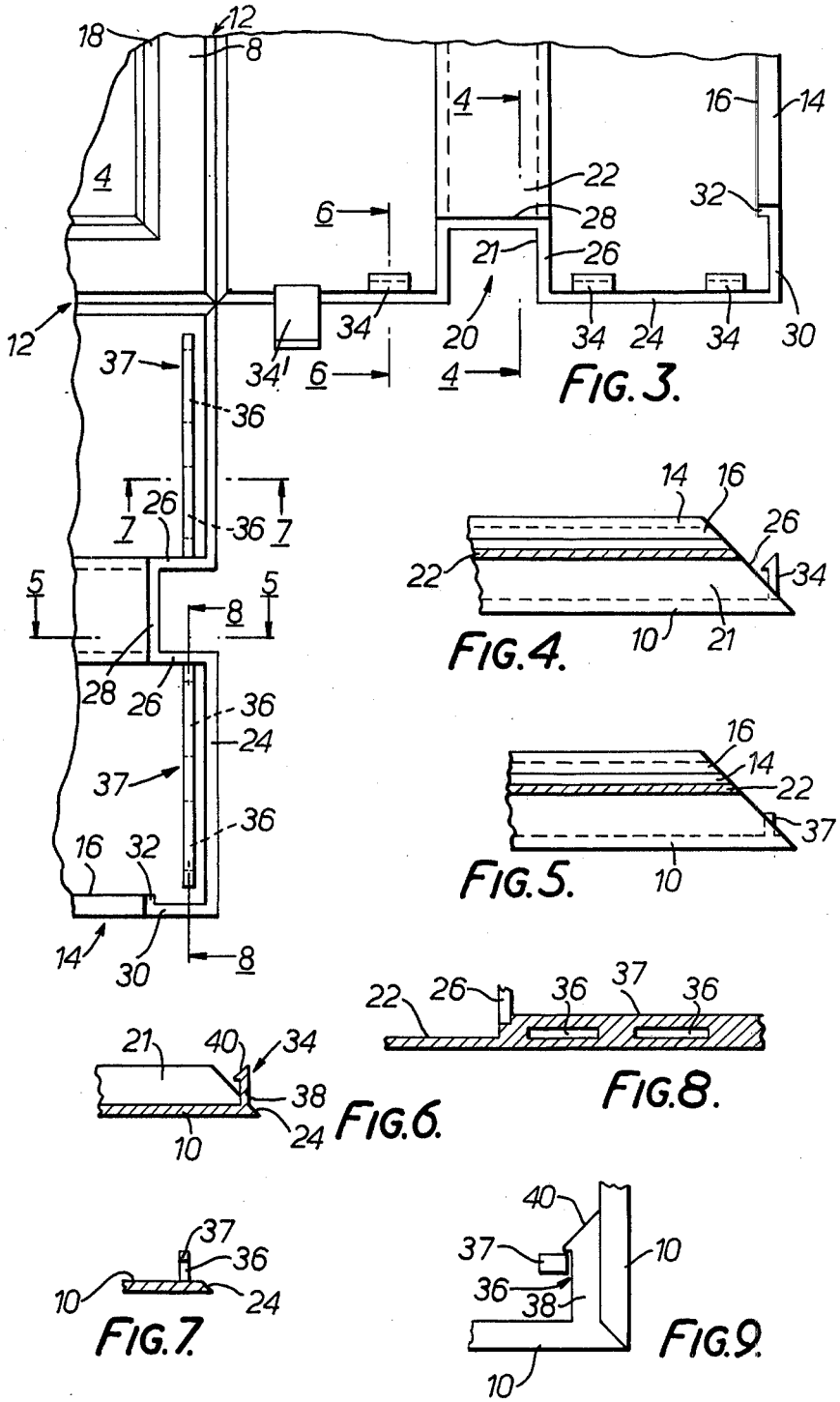
FIG. 3 is a detailed view of the underside of one of the corner regions of the blank.
FIG. 4 is a cross-sectional view taken along the line 4—4 in FIG. 3.
FIG. 5 is a cross-sectional view taken along the line 5—5 in FIG. 3.
FIG. 6 is a cross-sectional view taken along the line 6—6 in FIG. 3.
FIG. 7 is a cross-sectional view taken along the line 7—7 in FIG. 3.
FIG. 8 is a cross-sectional view taken along the line 8—8 in FIG. 3.
FIG. 9 shows the components illustrated in FIGS. 6 and 8 when interlocked on erection of the blank to form the drawer.

Referring now to FIGS. 3, 4 and 5 it will be seen that the side edges of the panels 10 include mitred edge faces 24 which are inclined at 45° to the plane of the panels 10. The side walls 21 and bottoms 22 of the channels 20 require corresponding mitred edge faces 26 and 28. Similarly the flanges 14 and projections 16 require mitred edge faces 30 and 32 respectively. A mitre joint can therefore be formed at the side edges of the panels 10 when they are swung about their hinge connections until corresponding mitred edge faces 24, 26, 28, 30 and 32 engage. This corresponds to a position in which the projections 16 interlock with the ribs 18 of the base.

To assist in maintaining integrity of the mitre joint between adjacent side edges of the panels 10 two pairs of projections 34 are provided along a side edge of one of the panels 10 and two complementary pairs of slots 36 are formed in bodies 37 located at the adjacent side edge of the other of the panels 10, as best seen in FIGS. 4 to 9. In FIG. 3 one of the projections 34', enclosed within broken lines, has been rotated through 90° to facilitate understanding of the drawing. FIG. 6 illustrates one of the projections 34 in greater detail. It will be seen that it comprises an upstanding portion 38 projecting from the panel 10 immediately inwardly of the mitred edge face 24 of the panel 10. The upper inward edge of the upstanding portion 38 is formed with a locking lip 40. The slots 36 are made wider than the corresponding widths of the projections 34 to permit the latter to be easily inserted in the former during erection. FIG. 9 shows the projection 34 interlocked with the slot 36. It will be seen that the portion 38 extends through the slot until its lip 40 engages a rearward face of the body 37, the body 37 being resiliently deformed by the lip 40 as the lip passes through the slot 36.

It will be appreciated that the blanks 2 can be molded in a single step, nested for compact storage and transport, and easily erected by unskilled persons ready for use as a drawer. The external dimensions of the drawer are accurately determined in the initial molding process of the blank and are not subjected to the competence of the person erecting the drawer.

The claims defining the invention are as follows:

1. A one-piece injection molded drawer comprising:

an open topped box-like structure having integral side walls and base;

four outer side walls hingedly connected to said structure, each of said outer side walls overlying one of said integral side walls of the box-like structure and being mechanically interlocked to said box-like structure;

flanges molded between the top side edges of the side walls of said structure and the outer side walls, adjacent ends of said flanges being integrally connected so as to form a continuous flange at the top of the drawer, said side edges of the outer side walls being integrally connected to said flanges by hinge joints; and lower flanges formed on the lower side edges of the outer side walls, the ends of said lower flanges being mitred so as to form a continuous flange beneath the plane of the base of said structure, the free edges of said lower flanges formed on the lower side edges of the outer side walls being formed with up-turned lips and the base of the structure being formed with projecting ribs which co-operate with said lips to effect said interlock between the outer side walls and said structure.

2. A drawer as claimed in claim 1 wherein spacing formations are provided in the outer side walls to maintain separation of adjacent outer side walls and the side walls of said structure.

3. A drawer as claimed in claim 2 wherein the spacing formations comprise channels formed into the outer side walls, the bases of the channels being parallel to and in engagement with the side walls of said structure.

4. A drawer as claimed in claim 3 wherein the location of the channels in the outer side walls is such that a continuous channel is formed about the exterior of the drawer.

5. A drawer as claimed in claim 1 wherein the edges of the outer side walls are mitred so that mitre joints are formed between adjacent outer side walls.

6. A drawer as claimed in claim 1 wherein end edges of adjacent outer side walls are mechanically interlocked together.

7. A drawer as claimed in claim 6 wherein, at each corner of the drawer, one of the end edges of the outer side walls is provided with slots and the other of the end edges of the outer side walls is provided with projections which interlock with the slots.

8. A drawer as claimed in claim 1 wherein the side walls of said structure diverge outwardly relative to the base thereof.

9. A one-piece injection molded blank for forming a drawer, said blank comprising:

an open topped box-like structure having integral side walls and base;

four panels hingedly connected to said structure each of which is foldable to positions where it overlies a respective one of said integral side walls of the box-like structure, said panels serving as outer side walls for the drawer;

flanges molded between the top side edges of the side walls of said structure and the panels, adjacent edges of said flanges being integrally connected so as to form a continuous flange at the top of the box-like structure, inner side edges of the panels being integrally connected to said flanges by hinge joints; and further flanges formed on outer, free side edges of the panels, the ends of said further flanges being mitred as to form a continuous flange beneath the plane of the base of said structure, when the panels are in said positions, each of said panels being provided with formations which permit it to be mechanically interlocked to the box-like structure, when in its said position, said formations including up-turned lips formed on the free edges of the flanges formed on the outer, free side edges of the panels, said base of said structure being formed with projecting ribs which cooperate with said lips to effect said interlock between the panels and said structure.

10. A blank as claimed in claim 9 wherein spacing formations are provided in the panels to maintain separation of adjacent panels and the side walls of said structure, when the panels are in said positions.

11. A blank as claimed in claim 10 wherein the spacing formations comprise channels formed into the panels the bases of the channels being parallel to and in engagement with the side walls of said structure, when the panels are in said positions.

12. A blank as claimed in claim 11 wherein the location of the channels in the panels is such that a continuous channel is formed about the exterior of the drawer, when the panels are in said positions.

13. A blank as claimed in claim 9 wherein end edges of the panels are mitred so that mitre joints are formed between adjacent panels, when in their said positions.

14. A blank as claimed in claim 9 wherein additional formations are provided at the edges of the panels to mechanically interlock end edges of adjacent panels when in said positions.

15. A blank as claimed in claim 14 wherein additional formations comprise, at each pair of adjacent end edges of panels, slots formed on the end edge of one of the panels and projections formed on the end edge of the other of the panels, said slots and projections being interlockable when the panels are in said positions.

16. A blank as claimed in claim 9 wherein the side walls of said structure diverge outwardly relative to the base thereof.

17. A nestable blank constructed of a plastic material including an open top drawer having a bottom wall, integral upstanding side walls with each of said side walls terminating in a continuous uninterrupted flange portion, panels integrally formed with each of said flange portions, said panels being foldable relative to said continuous uninterrupted flange portion to thereby be brought into generally parallel spaced relation with each of said side walls, extending projections located at the extremity of each of said panels arranged to securely overlie ribs positioned substantially at the circumferential exterior of said bottom wall to secure each of said panels in a plane generally parallel to said upstanding side wall with which it is associated when said panel is so bent.

18. A nestable blank as in claim 17, in which each of said panels is provided with a channel that lies in a plane parallel with said uninterrupted flange portion, said channel further having a depth such that an exterior wall thereof is brought into intimate contact with the respective upstanding side walls of said blank to thereby rigidify the same upon said projections being secured to said ribs.

19. A nestable blank as in claim 17, in which each of said panels include laterally disposed mitred edge portions which are brought into juxtaposed abutting relation when each of said panels is bent into locking engagement with said ribs by said projections.

20. A nestable blank as in claim 19, in which each of said laterally disposed mitred edge portions of said panels includes complemental locking means to maintain the mitred edge of each respective adjacent panel in abutting relation when said panels are bent into locking engagement with said ribs by said projections.

* * * * *